US008899244B2

(12) United States Patent
Faust

(10) Patent No.: US 8,899,244 B2
(45) Date of Patent: Dec. 2, 2014

(54) NON-SLIP HAIR ACCESSORIES INCLUDING DUAL-PURPOSE LABELS FOR DISPLAYING INDICIA AND/OR FOR PROVIDING NON-SLIP FEATURES

(71) Applicant: Wee Ones, LLC, Earth City, MO (US)

(72) Inventor: Miles P. Faust, Kirkwood, MO (US)

(73) Assignee: Wee Ones, LLC, Earth City, MO (US)

( * ) Notice: Subject to any disclaimer, the term of this patent is extended or adjusted under 35 U.S.C. 154(b) by 0 days.

(21) Appl. No.: 14/060,285

(22) Filed: Oct. 22, 2013

(65) Prior Publication Data

US 2014/0261528 A1 Sep. 18, 2014

Related U.S. Application Data

(60) Provisional application No. 61/783,728, filed on Mar. 14, 2013.

(51) Int. Cl.
*A45D 8/12* (2006.01)
*A45D 8/24* (2006.01)

(52) U.S. Cl.
CPC ..... *A45D 8/24* (2013.01)
USPC ..... 132/275

(58) Field of Classification Search
USPC ..... 132/273–278
See application file for complete search history.

(56) References Cited

U.S. PATENT DOCUMENTS

| | | | | |
|---|---|---|---|---|
| 5,996,593 | A | 12/1999 | Horman | |
| 7,461,661 | B2 | 12/2008 | Chudzik et al. | |
| 7,690,388 | B2 | 4/2010 | Rogers | |
| 7,766,020 | B2 | 8/2010 | Chininis et al. | |
| 2003/0221700 | A1* | 12/2003 | La Fauci | 132/276 |
| 2004/0055616 | A1 | 3/2004 | Twomey | |
| 2004/0065341 | A1 | 4/2004 | La Fauci | |
| 2004/0231692 | A1 | 11/2004 | Shyu | |
| 2006/0021631 | A1* | 2/2006 | Lafauci | 132/277 |
| 2008/0142035 | A1* | 6/2008 | Hsu | 132/279 |
| 2009/0032044 | A1* | 2/2009 | Grimm | 132/200 |
| 2009/0255553 | A1* | 10/2009 | Hsu | 132/277 |
| 2011/0120493 | A1* | 5/2011 | Wills | 132/275 |
| 2012/0260935 | A1* | 10/2012 | Lalonde et al. | 132/275 |

OTHER PUBLICATIONS http://www.multimedia.3M.Bumpon; 3MTM BumponTM Protective Products; Feb. 2012; 5 pages.

http://www.multimedia.3CM.com.clear; 3M Clear Polypropylene Label Products; May 2006; 3 pages.

http://www.etsy.com; Nov. 29, 2012; 2 pages.

http://www.hairclippy.com; no slippy hair clippy® Nov. 29, 2012; 3 pages.

http://www.hairclippy.com/about; no slippy hair clippy® Nov. 29, 2012; 2 pages.

https://www.facebook.com/tripleflipgrip; Oct. 22, 2012; 5 pages.

* cited by examiner

*Primary Examiner* — Rachel Steitz

(74) *Attorney, Agent, or Firm* — Harness, Dickey & Pierce, P.L.C.

(57) ABSTRACT

Exemplary embodiments are disclosed of labels for hair accessories. The label may be used for displaying indicia (e.g., a company name, brand, logo, etc.). The label also provides a non-slip feature to help better hold the hair accessory in place. By way of example, the label may be applied along an inner surface of the hair accessory or pinch clip.

16 Claims, 5 Drawing Sheets

NON-SLIP HAIR ACCESSORIES INCLUDING DUAL-PURPOSE LABELS FOR DISPLAYING INDICIA AND/OR FOR PROVIDING NON-SLIP FEATURES

CROSS-REFERENCE TO RELATED APPLICATION

This application claims the benefit and priority of U.S. Provisional Application No. 61/783,728 filed Mar. 14, 2013. The entire disclosure of the above application is incorporated herein by reference.

FIELD

The present disclosure generally relates to non-slip hair accessories having dual-purpose labels that may be used for displaying indicia (e.g., a company name, brand, logo, etc.) and/or that may provide non-slip features to help better hold the hair accessory in place.

BACKGROUND

This section provides background information related to the present disclosure which is not necessarily prior art.

Hair accessories are commonly worn by girls in their hair. Examples of hair accessories include barrettes, bows, clips, decorative combs, headbands, etc.

SUMMARY

This section provides a general summary of the disclosure, and is not a comprehensive disclosure of its full scope or all of its features.

According to various aspects, exemplary embodiments are disclosed of labels for hair accessories. The label may be used for displaying indicia (e.g., a company name, brand, logo, etc.). The label also provides a non-slip feature to help better hold the hair accessory in place. Also disclosed are exemplary embodiments of hair accessories including such labels.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Example embodiments will now be described more fully with reference to the accompanying drawings.

Wee Ones has been in the girls' hair accessory business since 1978. For decades, the Wee Ones Company has marketed a line of handmade hair bows crafted from various types of ribbons and other fabrics. Wee Ones products are sold in over 1,500 specialty children's stores, gift boutiques, shoe stores, department stores and other retailers, as well as online at www.weeones.com and many other online shopping sites.

Most people in the hair accessory industry consider Wee Ones to be the leader and largest company in the market that serves specialty retail stores. Because of the status and reputation of Wee Ones in the industry, Wee Ones bows are emulated by many other companies, ranging from thousands of stay-at-home moms, small cottage industry companies, and a small group of sizable, established competitors. Despite the wide range of competitors, virtually no company has a brand that is recognized by consumers except Wee Ones. This brand recognition and image has been developed over decades, largely due to the breadth of the Wee Ones distribution and the clear and visible branding on the Wee Ones packages. In addition to these competitors, there are hundreds of other companies who import bows from other countries and supply goods to mass merchandisers, department stores, and other retailers, usually at much lower prices and crafted from inferior quality materials.

Figure 3:
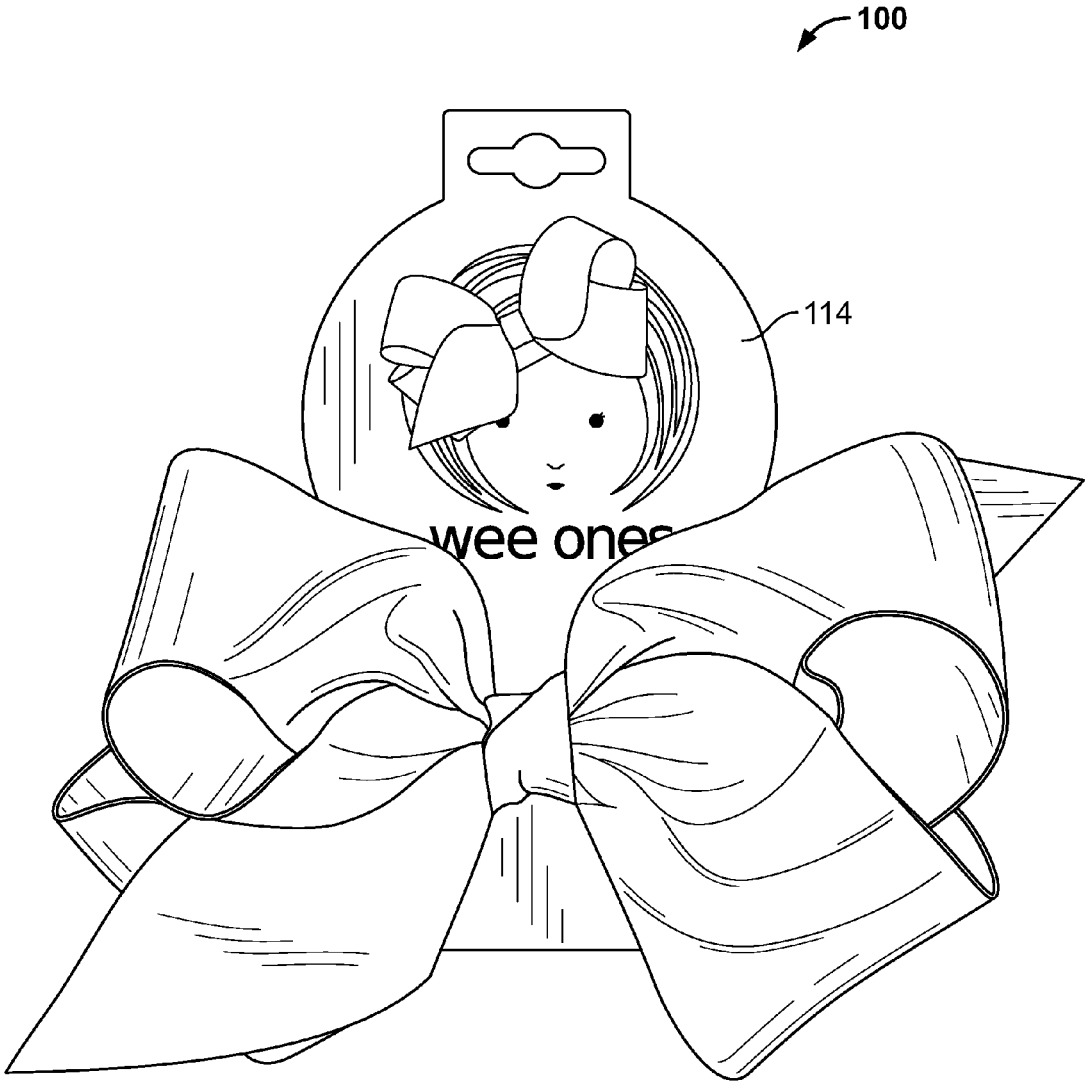
FIG. 3 is a front perspective view of the hair accessory shown in FIG. 1 with a hang tag.

After recognizing all of the above, the inventor also recognized problem with current branding and developed an innovative solution to solve this brand challenge. Wee Ones hair accessory products are typically merchandised in stores on a hang tag (e.g., hang tag 114 in FIG. 3, etc.), which hang tag may be branded with the Wee Ones logo and name. Wee Ones hair accessory products are also currently merchandised on hanging ribbon strips in stores.

The inventor hereof has recognized that though Wee Ones has a well-established brand name, once a consumer takes the Wee Ones hair bows off of the branded hang tags, cards, or ribbon strips, there is no lasting reminder that the bow is made by Wee Ones. This is a stark contrast to virtually any apparel item, which would have a tag or label with the brand name inside it. Simply put, there is currently nothing to tell a Wee Ones bow from a competitive product without the branded hang card.

Based on consumer feedback, the Wee Ones bows last longer than many others on the market. Accordingly the Wee Ones products have a very high quality reputation. Also, Wee Ones products provide both a functional and emotional benefit. On the functional level, they offer the benefit of keeping a little girl's hair out of her eyes and face. But there is also an emotional benefit of looking stylish, fashionable, pretty, or cute.

After realizing the importance of reinforcing brand names and images, the inventor developed an innovative and unique way of including a brand name on a hair accessory product itself, e.g., as an alternative or addition to only including the brand name on a hang tag or hang card. Accordingly, disclosed herein are exemplary embodiments of dual-purpose or functional labels that may be used for displaying one or more indicia (e.g., brand names, etc.) while also providing non-slip features to hair accessories. For example, a dual-purpose or functional label may be applied on a hair accessory product, such as along a surface of the portion (e.g., a back pocket or sleeve, etc.) of the hair accessory that receives a portion of the pinch clip (e.g., surface 106 in FIG. 1, etc.). As another example, a dual-purpose or functional label may be applied directly on an inner surface of a pinch clip. The label provides the dual benefit of including or displaying a brand name (e.g., Wee Ones or other name, etc.) while also providing a "non-slip" or friction creating function.

In an exemplary embodiment, a label may be applied along an inner surface of the hair accessory, which inner surface will be contacted or pinched by the pinch clip. The label includes indicia that are exposed and/or visible to the user when the pinch clip is open. With the label in place, there will be more friction between the label and the wearer's hair as compared to the friction between the wearer's hair and the pinch clip without the label present. By increasing the friction, the label thus provides a non-slip feature that will help better retain the hair accessory in place in the wearer's hair.

By way of example, a label may be created by laminating a label having indicia thereon (e.g., company name, brand, logo, customized with name of person that will be wearing the hair accessory, etc.) under a clear protective cover material, such as a polyurethane material manufactured by the 3M company (e.g., 3M clear polyurethane rollstock product, etc.).

The clear cover material includes an adhesive (e.g., acrylic based, pressures sensitive adhesive, etc.) that allows it to be laminated and bonded to the label such that the clear cover material is over the indicia, which indicia is visible through the clear cover material. Accordingly, a brand name (e.g., Wee Ones, etc.) or other indicia will be underneath the clear cover material.

The label may comprise colored indicia (e.g., blue letters, etc.) printed (e.g., via screen printing, flexographic printing, etc.) on a clear material (e.g., 3M clear polypropylene label stock, etc.) or a colored material depending on the end product and the color of the indicia. The material on which the indicia are printed includes adhesive (e.g., tackified acrylic, etc.) thereon for attachment to a substrate, e.g., portion of a pinch clip.

Figure 1:
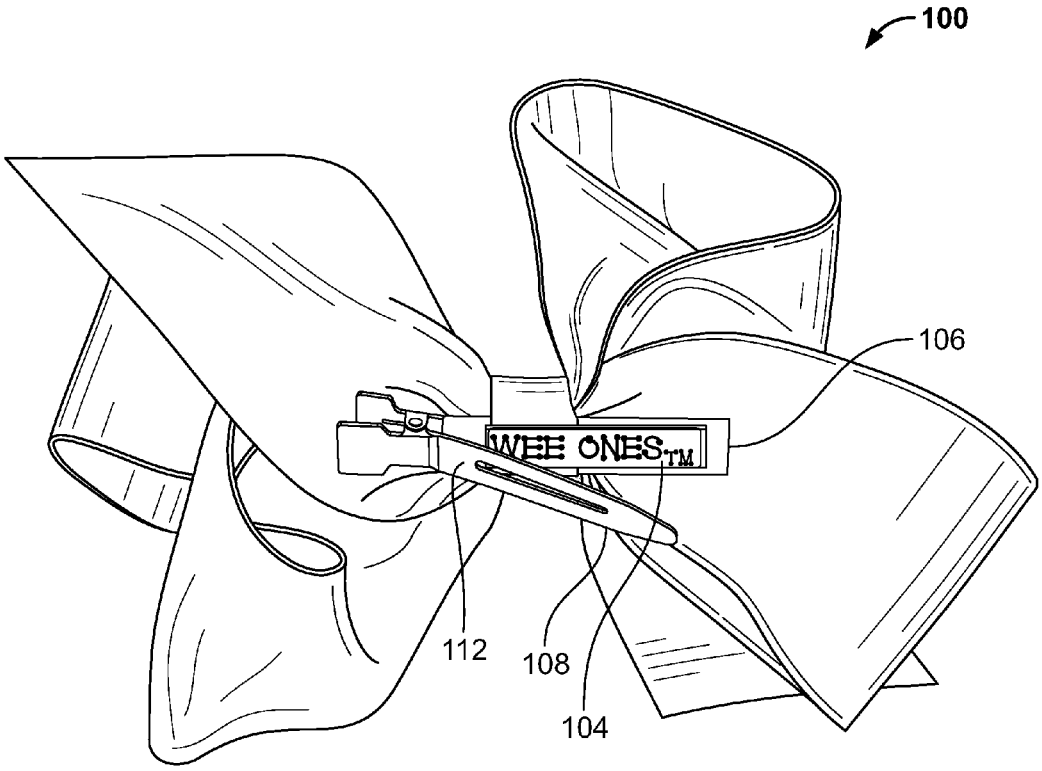
FIG. 1 is a perspective back of a hair accessory having a pinch clip with a dual-purpose label applied along an inner surface of the hair accessory or pinch clip according to an exemplary embodiment.
Figure 2:
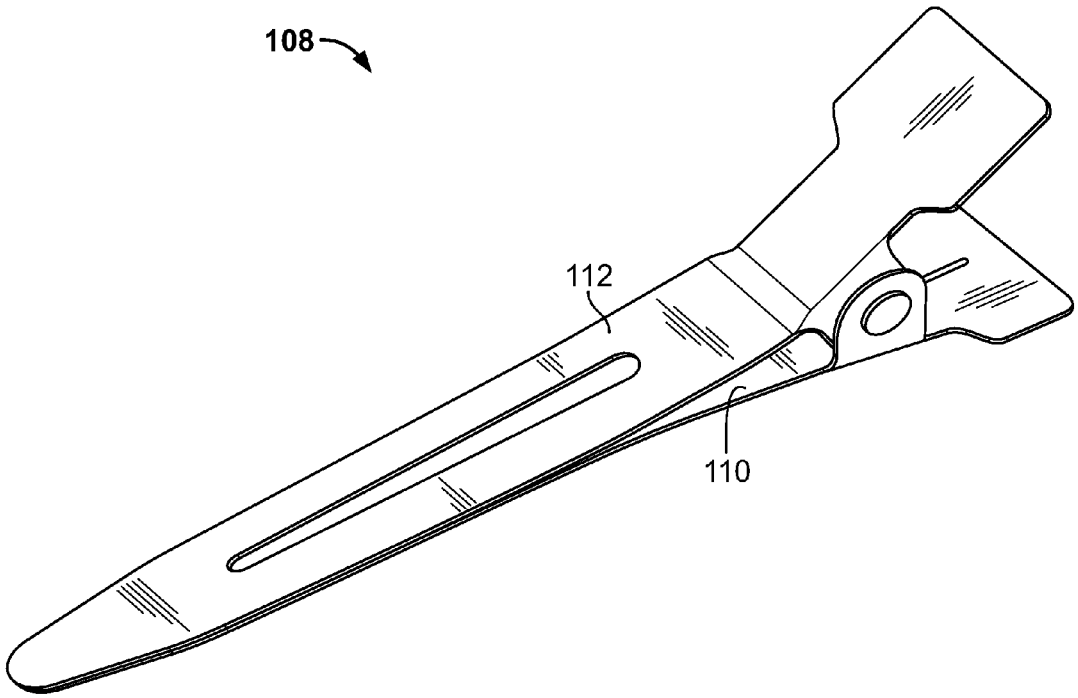
FIG. 2 is a perspective view of the pinch clip shown in FIG. 1.

Although there are different "attachment" options for hair accessories, including barrettes, pony tail holders, and "French clips", a very popular attachment on a hair bow is a "pinch clip" (e.g., pinch clip 108 shown in FIGS. 1 and 2, etc.). Though conventional pinch clips may adequately hold and retain a hair accessory in place, the additional friction created by the inventor's label may allow a pinch clip to even better hold the hair accessory in place. By way of example, an exemplary embodiment includes an adhesive label having indicia thereon where the label is applied (e.g., manually applied by hand, etc.) along a portion of the hair accessory that will be contacted or pinched by the pinch clip after the bow or other hair accessory has been constructed. As another example, another exemplary embodiment includes an adhesive label having indicia thereon where the label is applied (e.g., manually applied by hand, etc.) on the pinch clip.

The additional non-slip feature and branding provided by exemplary embodiments of the dual-purpose functional labels disclosed herein may advantageously provide a meaningful marketing message and/or motivate both consumers and retailers to choose Wee Ones hair accessories over another brand. Exemplary embodiments of the labels disclosed herein may be labeled differently and/or customized with other brands, indicia, etc. besides Wee Ones depending on the end products to which the labels will be applied.

FIG. 1 illustrates an exemplary embodiment in which a hair accessory 100 includes a dual-purpose label 104 embodying one or more aspects of the present disclosure. As shown in FIG. 1, the label 104 is disposed along an inner surface 106 of the hair accessory 100. The inner surface 106 comprises a portion of the hair accessory 100 that defines or provides a back pocket, sleeve, etc. that receives the inner part 110 (FIG. 3) of the pinch clip 108. Accordingly, the label 104 is located along the portion of the hair accessory 100 that will be contacted or pinched by the outer part 112 of the pinch clip 108 when the pinch clip 108 is closed. Alternatively, the label 104 may be disposed along or directly attached to the pinch clip 108 (e.g., along an inner surface of the inner or outer part 110, 112 of the pinch clip 108, etc.) in other exemplary embodiments.

The label 104 includes indicia thereon. For example, the indicia may comprise colored indicia having a color different than the label color, such as Wee Ones™ in blue letters on a white label. The indicia may be printed (e.g., via a flexographic printer or printer process, etc.) on white label stock such that the blue letters are visible against or with a white background around the blue letters.

In other exemplary embodiments, the dual-purpose labels may include indicia on a clear or transparent label stock. For example, colored (e.g., blue, etc.) indicia may be printed (e.g., via a flexographic printer or printer process, etc.) on clear label stock such that the colored letters, numbers, images, logos, other indicia, etc. are visible against or with a background defined by the color of the ribbon. Also, the label stock includes adhesive (e.g., tackified acrylic adhesive, etc.) to allow the label to be attached to the surface 106 of the hair accessory 100, to a surface of the pinch clip 108, or other substrate.

A clear cover material is laminated over the label stock having the indicia. The clear cover material includes an adhesive (e.g., acrylic based, pressures sensitive adhesive, etc.) that allows it to be laminated and bonded to the label such that the clear cover material is over the indicia. As shown in FIG. 1, the indicia or letters in this example are visible through the clear cover material.

A wide range of materials may be used for the label stock or substrate material having the indicia thereon. By way of example, the label stock may comprise a polypropylene label product from the 3M Company, e.g., 3M Clear Polypropylene Label Product FP024802, FP025409, or FP032708 that are clear materials utilizing 3M adhesive P1480 tackified acrylic, as described in Appendix A attached to U.S. Provisional 61/783,728 which is incorporated herein by reference. In one particular embodiment, the label stock comprises 3M Clear Polypropylene Label Product FP024802 that includes a polypropylene facestock having a thickness of about 0.002 inches, P1480 tackified acrylic adhesive, and a liner (e.g., 3.1 mil semi-bleached super calendered kraft sheet, etc.). A wide range of other suitable materials may instead be used for the label stock or substrate material having the indicia.

A wide range of materials may also be used for the cover material laminated over the label stock. The cover material has adhesive (e.g., acrylic based, pressure sensitive adhesive, etc.) for attachment to the label stock over the indicia. For example, the cover material may comprise a 2-mil polyethylene terephthalate (PET) with acrylic adhesive. Also by way of example, the cover material may comprise a clear polyurethane rollstock product from the 3M Company, e.g., 3M Bumpon Protective Product Resilient Rollstock—Clear Series SJ5600 as described in Appendix B attached to U.S. Provisional 61/783,728 which is incorporated herein by reference. In one particular embodiment, the cover material comprises 3M Bumpon Protective Product SJ5632 having a thickness of about 1/32 inch+/−0.010 inches. A wide range of other suitable materials may instead be used for the clear cover material.

An exemplary processes for making dual-purpose or functional labels disclosed herein generally includes adding indicia (e.g., via printing with a flexographic printer or other printing process, etc.) to label stock. The indicia may comprise any of a wide range of graphics, letters, numbers, symbols, logos, images, etc. By way of example, the indicia may comprise a company name, brand, logo, logo with registration marks, or be customized with the name of the person to which the hair accessory is being given as a gift and/or that will be wearing the hair accessory, etc. Customizing the indicia with a person's name may allow that person to readily distinguish that person's hair accessories from another person's hair accessories.

After the indicia are added to the label stock a cover material may be added over the top of the label stock having the indicia. For example, a clear bumpon material having adhesive thereon may be laminated to the top of the label stock in line with lamination rollers.

By way of example, an XY plotter may be used to read the registration marks or other indicia on a sheet of the label stock (e.g., one yard sheets, etc.) and to cut the individual labels or parts out from the sheet. Or, for example, the various steps may be performed in one pass and cut with a rotary tool. In which case, the following steps may be performed in one pass: printing indicia for individual labels to a sheet of label stock, laminating cover material over the sheet of label stock, and using a rotatory tool to cut the individual labels from the laminated sheet of label stock and cover material.

Figure 4:
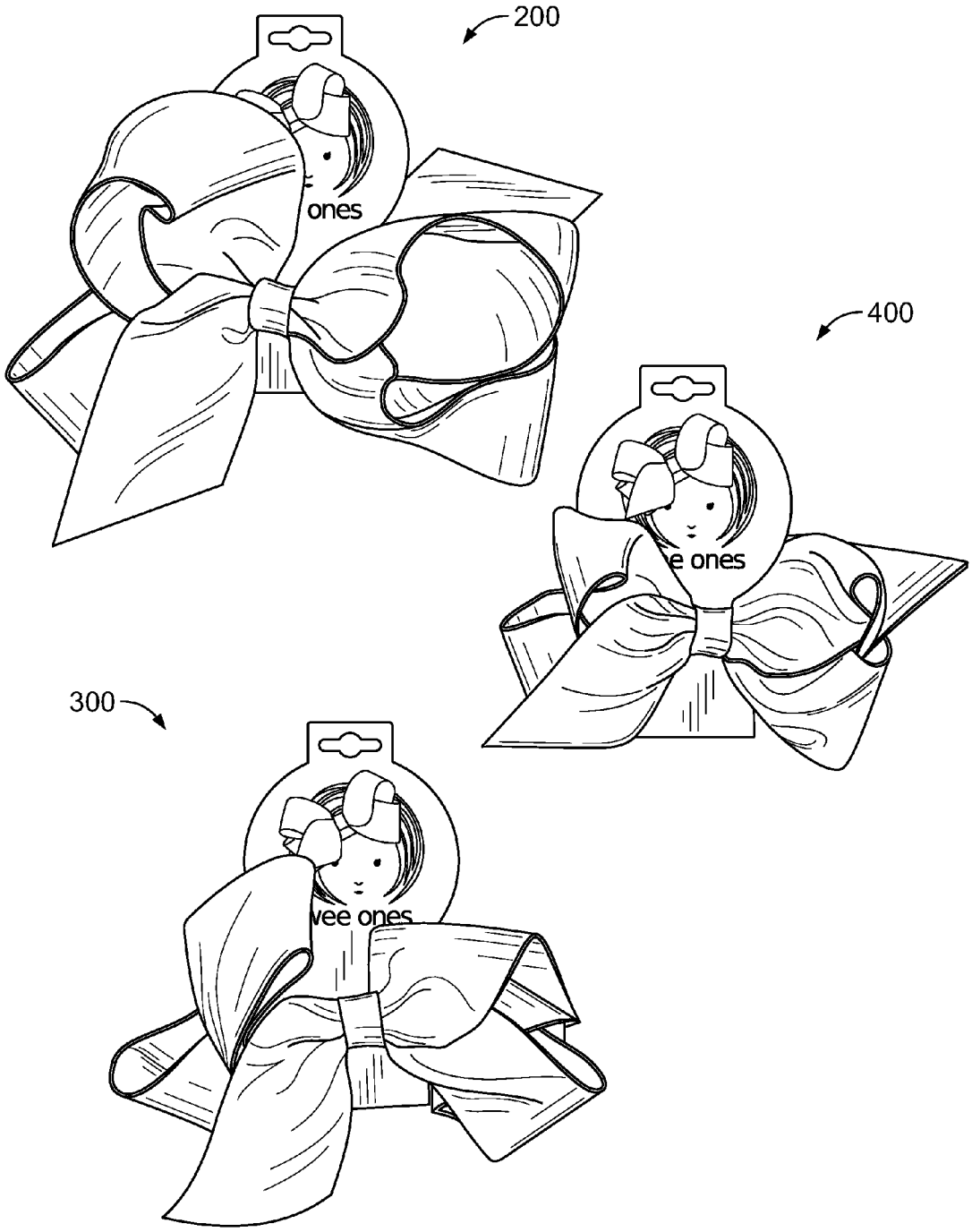
FIG. 4 is a perspective view showing three different hair accessories with hang tags, which hair accessories may include a dual-purpose label applied along an inner surface of the hair accessory or pinch clip as shown in FIG. 1.
Figure 5:
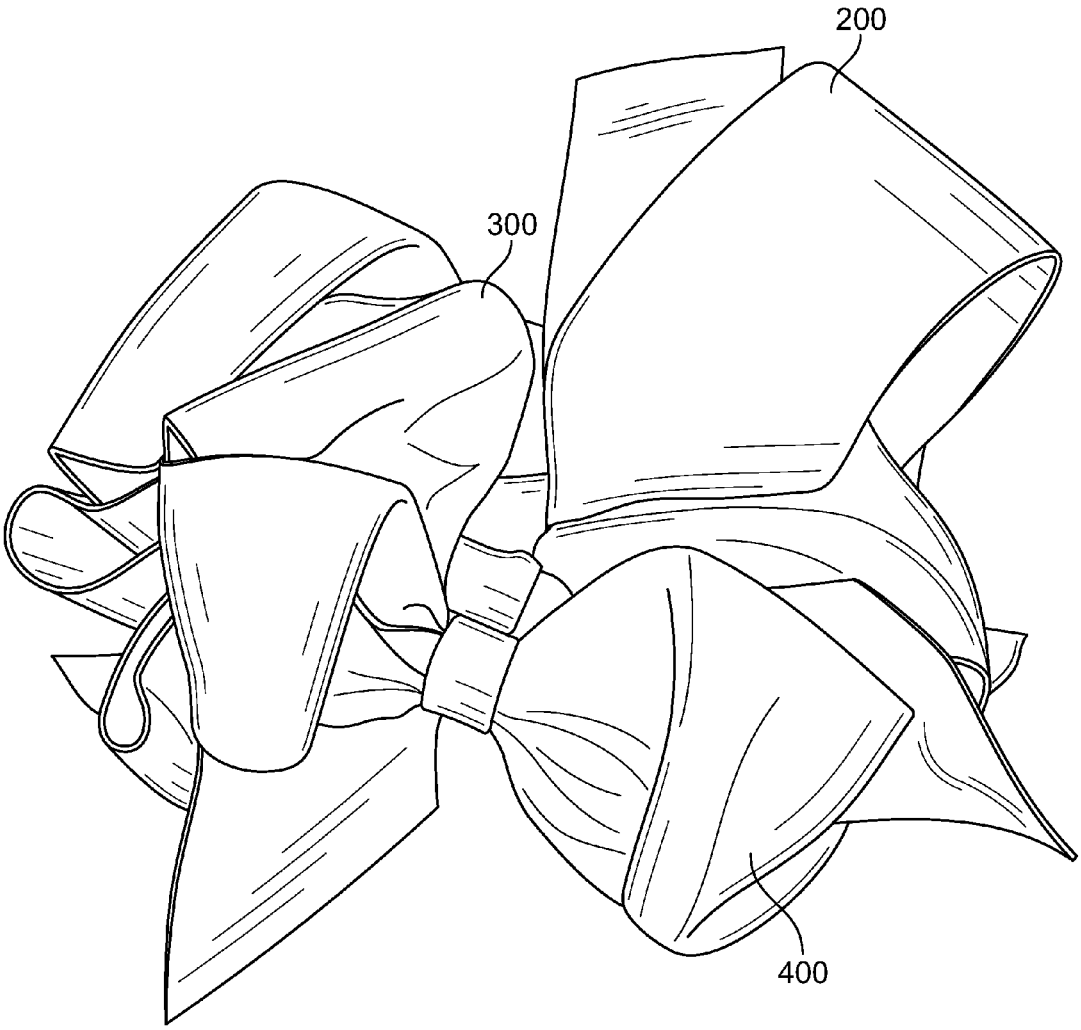
FIG. 5 is a perspective view of the hair accessories shown in FIG. 4 stacked or combined together.

FIG. 4 shows three different hair accessories 200, 300, 400, which may include a dual-purpose label as shown in FIG. 1. The three hair accessories 200, 300, 400 may be stacked or combined together as shown in FIG. 5. Advantageously, adhesively attaching a dual-purpose label along an inner surface of a hair accessory or pinch clip as disclosed herein does not prevent bow stacking as shown in FIG. 5.

In other exemplary embodiments, a label may include a single layer of material without any lamination. In such exemplary embodiments, the single layer of material may include indicia thereon (e.g., on the top or bottom, etc.). The single layer of material may include adhesive for attachment to a hair accessory, pinch clip, or other item. By way of example, the single layer of material may comprise label stock and/or clear bumpon material having adhesive thereon, such as the example materials disclosed in Appendices A and B attached to U.S. Provisional Application No. 61/783,728.

In additional exemplary embodiments, the label may be provided without any indicia thereon and/or may be provided in a wide range of colors. In such exemplary embodiments, the label may still be configured to provide a non-slip feature to a hair accessory. For example, the label without any indicia may be along an inner surface of a hair accessory that will be contacted or pinched by the pinch clip, such that the label increases friction between the label and a wearer's hair as compared to the friction between the wearer's hair and the inner surface of the hair accessory or pinch clip without the label present. The label without the indicia may comprise label stock and/or clear bumpon material having adhesive thereon, such as the example materials disclosed in Appendices A and B attached to U.S. Provisional Application No. 61/783,728.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally," "about," and "substantially," may be used herein to mean within manufacturing tolerances. Or for example, the term "about" as used herein when modifying a quantity of an ingredient or reactant of the invention or employed refers to variation in the numerical quantity that can happen through typical measuring and handling procedures used, for example, when making concentrates or solutions in the real world through inadvertent error in these procedures; through differences in the manufacture, source, or purity of the ingredients employed to make the compositions or carry out the methods; and the like. The term "about" also encompasses amounts that differ due to different equilibrium conditions for a composition resulting from a particular initial mixture. Whether or not modified by the term "about," the claims include equivalents to the quantities.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A hair accessory comprising:

a bow and/or ribbon;

a pinch clip coupled to the bow and/or ribbon for holding the bow and/or ribbon in a wearer's hair; and a label adhesively attached along a surface of the bow and/or ribbon that is pinched by the pinch clip when the pinch clip is closed;

whereby the label is operable for displaying indicia when the pinch clip is open and for increasing friction to allow the pinch clip to better hold the hair accessory in the wearer's hair;

wherein the label provides a non-slip feature as friction between the label and the wearer's hair is greater than friction between the wearer's hair and the pinch clip without the label present, wherein the label comprises:

a label stock having indicia flexographically or screen printed thereon, the label stock including an adhesive that adhesively attaches the label along the surface of the bow and/or ribbon; and a clear cover material laminated to the label stock.

2. The hair accessory of claim 1, wherein:

the bow and/or ribbon comprises a pocket that receives a portion of the pinch clip to thereby retain the pinch clip;

the label is adhesively attached along an outer surface of the pocket that is pinched between inner and outer parts of the pinch clip when the pinch clip is closed.

3. The hair accessory of claim 1, wherein the label includes indicia comprising one or more of a name, a brand, or a logo that is exposed and/or visible when the pinch clip is open.

4. The hair accessory of claim 3, wherein the indicia of the label is concealed by the pinch clip when the pinch clip is closed.

5. A hair accessory comprising:

a pinch clip for holding the hair accessory in a wearer's hair; and a label adhesively attached along a surface of the hair accessory that is operable for providing a non-slip feature that increases friction to allow the pinch clip to better hold the hair accessory in the wearer's hair;

wherein the label includes indicia that is exposed and/or visible when the pinch clip is open;

wherein the label includes indicia comprising one or more of a name, a brand, or a logo, and wherein the label comprises:

a label stock having the indicia flexographically or screen printed thereon, the label stock including an adhesive that adhesively attaches the label along the surface of the hair accessory; and a clear cover material laminated to the label stock.

6. The hair accessory of claim 5, wherein the label is adhesively attached along a surface of the hair accessory that is pinched between inner and outer parts of the pinch clip when the pinch clip is closed.

7. The hair accessory of claim 6, wherein the indicia of the label is concealed by the pinch clip when the pinch clip is closed.

8. The hair accessory of claim 5, wherein:

the hair accessory includes a pocket that receives a portion of the pinch clip to thereby retain the pinch clip;

the label is adhesively attached along an outer surface of the pocket that is pinched between inner and outer parts of the pinch clip when the pinch clip is closed, and the label is operable to increase friction such that friction between the label and the wearer's hair is greater than friction between the wearer's hair and the pinch clip without the label present.

9. The hair accessory of claim 5, wherein the label is along a surface of the pinch clip.

10. The hair accessory of claim 5, wherein:

the hair accessory comprises a bow and/or a ribbon;

the bow and/or ribbon includes a pocket that receives a portion of the pinch clip to thereby retain the pinch clip; and the label is adhesively attached along an outer surface of the pocket that is pinched between inner and outer parts of the pinch clip when the pinch clip is closed, such that friction between the label and the wearer's hair is greater than friction between the wearer's hair and the pinch clip without the label present.

11. The hair accessory of claim 10, wherein the label is exposed and/or visible when the pinch clip is open.

12. The hair accessory of claim 10, wherein the label includes indicia that is exposed and/or visible when the pinch clip is open and that is concealed by the pinch clip when the pinch clip is closed.

13. The hair accessory of claim 5, wherein the label is configured such that friction between the label and the wearer's hair is greater than friction between the wearer's hair and the pinch clip without the label present.

14. A hair accessory comprising:

a pinch clip for holding the hair accessory in a wearer's hair; and a label adhesively attached along a portion of the hair accessory, for displaying indicia and providing a non-slip feature that helps to better hold the hair accessory in place in the wearer's hair;

wherein the indicia on the label is visible when the pinch clip is open; and whereby the label is operable for increasing friction between the label and the wearer's hair which increased friction helps the pinch clip better hold the hair accessory in the wearer's hair;

wherein the label comprises indicia flexographically or screen printed thereon, a label stock including an adhesive that adhesively attaches the label along the portion of the hair accessory, and a clear cover material laminated to the label stock.

15. The hair accessory of claim 14, wherein the hair accessory comprises a bow and/or a ribbon.

16. The hair accessory of claim 14, wherein:

the hair accessory includes a pocket that receives a portion of the pinch clip to thereby retain the pinch clip; and the label is adhesively attached along an outer surface of the pocket that is pinched by the pinch clip when the pinch clip is closed.

* * * * *